US006092293A

United States Patent [19]

Donaldson

[11] Patent Number: 6,092,293

[45] Date of Patent: Jul. 25, 2000

[54] PENCIL SHARPENER

[76] Inventor: Joseph Donaldson, 130 N. Morgan, Wheaton, Ill. 60187

[21] Appl. No.: 09/266,354

[22] Filed: Mar. 11, 1999

Related U.S. Application Data

[63] Continuation-in-part of application No. 09/243,365, Feb. 1, 1999.

[51] Int. Cl.[7] ..... B43L 23/00

[52] U.S. Cl. ..... 30/457; 30/461

[58] Field of Search ..... 30/451–462

[56] References Cited

FOREIGN PATENT DOCUMENTS 2010336 9/1971 Germany ..... 30/453

*Primary Examiner*—Douglas D. Watts
*Attorney, Agent, or Firm*—Douglas B. White

[57] ABSTRACT

There is described herein a sharpener for a carpenter's pencil having a centering collar mounted to an enclosure for relative rotation to generate the sharpening effect. Within the base enclosure there is a symmetrical pencil point contour surface and a blade mounted along the contour for cutting against the inserted pencil. The shape of the blade is either curved or formed from a plurality of sections to produce a narrow cut around the point extremity of the pencil and a wider cut further up the pencil shaft.

20 Claims, 4 Drawing Sheets

FIG. 1
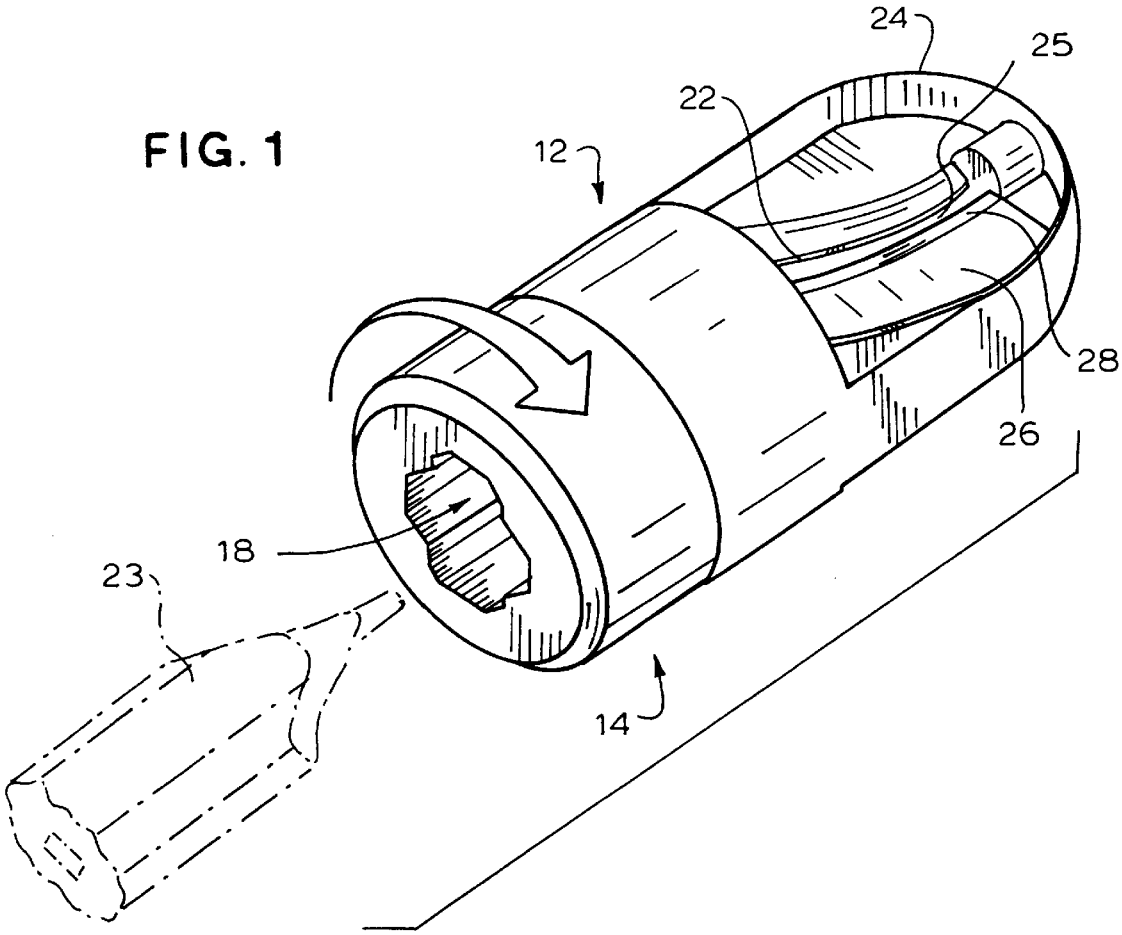
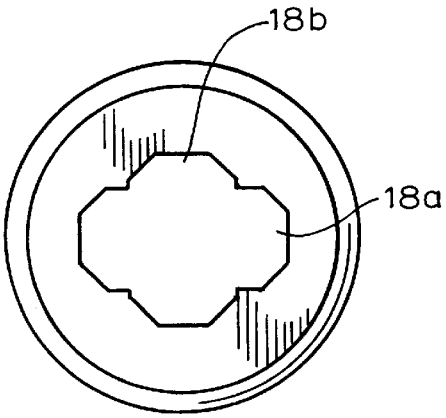
FIG. 2
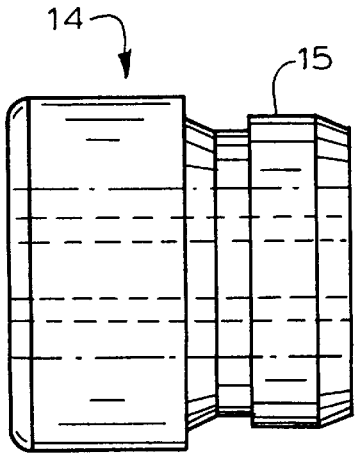
FIG. 3

PENCIL SHARPENER

This is a continuation in part of U.S. patent application Ser. No. 09/243,365, filed Feb. 2, 1999, now abandoned.

BACKGROUND OF THE INVENTION

1. Field of the Invention

The present invention relates generally to devices for sharpening pencils and more particularly to sharpeners designed for the flattened style of carpenter's pencils.

2. Description of the Prior Art

The need for a sharpening device designed for the sharpening of a carpenter's pencil has long been well known, as sharpening has generally required the use of a knife to accommodate the odd shape of the pencil. The difficulty of sharpening this style of pencil with such a sharpening device without leaving wood on the broad sides of the rectangular pencil lead has long presented a major obstacle. For example, in U.S. Pat. No. 5,077,903 a sharpener is presented with dual rotary cutter assemblies arranged to cut two curves in the point. In U.S. Pat. Nos. 4,759,129 and 4,918,816 four cutters and associated gearing are similarly used to achieve the desired sharpening effect on a carpenter's pencil. In U.S. Pat. No. 4,081,010 a cutting blade is driven around the pencil in a complicated "eccentric" motion by means of cams to achieve the required pencil point shaping. Clearly, the need for a simplified device that does not require the many blades, gears and motors of the prior art has been long sought after, yet such a device has not previously been developed.

SUMMARY OF THE INVENTION

The present invention presents a simplified solution for a device which will sharpen a carpenter's pencil. Particularly, there is provided a base enclosure having a symmetrical pencil point contoured surface defined therein. A blade mounted within the base enclosure conforms to the contour and cuts against an inserted pencil. A pencil centering collar is mounted to the base enclosure for receiving the pencil and for rotating the pencil relative to the base enclosure to cause the sharpening effect on the pencil.

BRIEF DESCRIPTION OF THE DRAWINGS

FIG. 1 is a perspective of a sharpening device in accordance with the present invention, showing a pencil oriented for insertion therein.

FIG. 2 is an end view of the collar portion of the sharpening device of FIG. 1, showing the crossed slot feature.

FIG. 3 is a side view of the collar of FIG. 2.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 6:
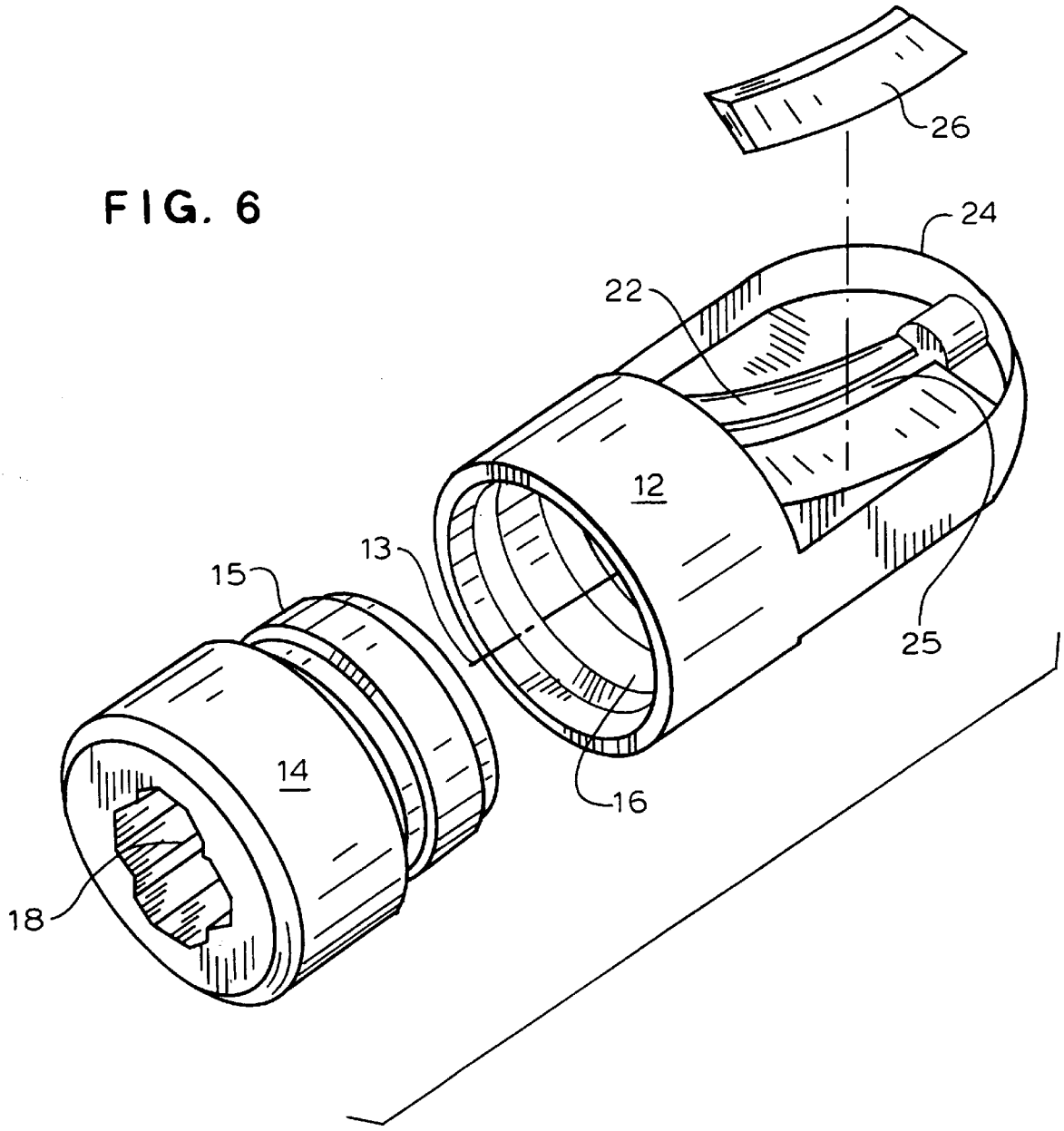
FIG. 6 is an exploded view of the sharpening device of FIG. 1.

Turning first to FIG. 1 there is shown a pencil sharpening device in accordance with the present invention, having a base enclosure 12 and pencil centering means, such as a centering collar 14, mounted to the base enclosure for rotation relative thereto. The collar 14 exhibits an encircling shoulder 15 (FIG. 3) arranged to removably fit within a resilient track 16 encircling the end of the base enclosure 12 for allowing rotation of the collar relative to the base enclosure 12 about a central axis 13 (FIG. 6).

The collar further presents an opening 18 for insertion of a pencil to be sharpened, and in the preferred embodiment the collar opening is in the form of intersecting rectangular slots (FIG. 2) designed to accommodate the dimensions of a plurality of sizes of carpenter's pencils. For example, a wide pencil can be positioned within the wide slot 18*a* and a narrow pencil can be positioned within the narrow slot 18*b*. Consequently, rotation of the collar with the pencil inserted through the collar into the base enclosure causes the pencil to rotate about the central axis for the sharpening effect as hereinafter described.

Figure 4:
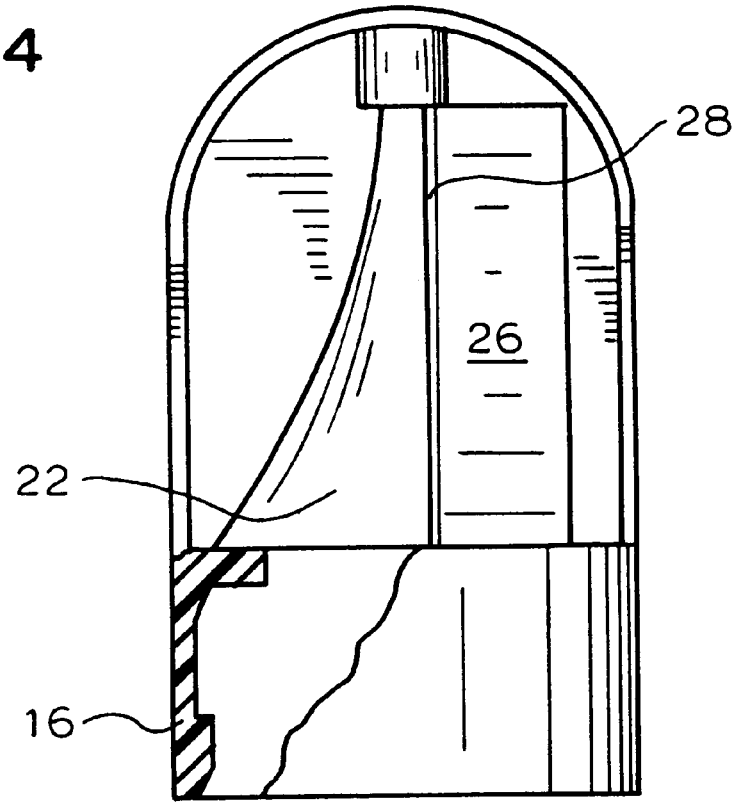
FIG. 4 is a combination cut away and cross section view of the base enclosure portion of the sharpening device of FIG. 1, viewed from the top with a portion of the longitudinally concave conical contoured surface and collar cut away.
Figure 5:
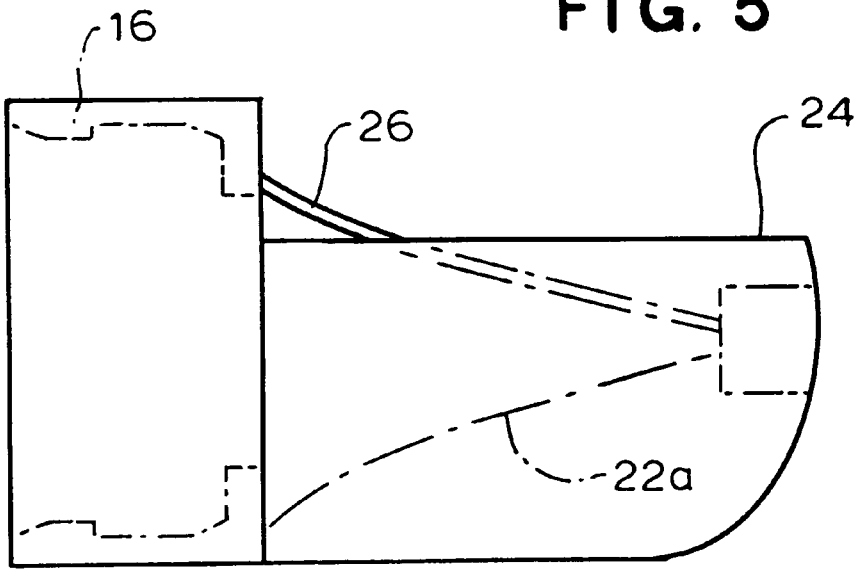
FIG. 5 is a cross section view of the base enclosure portion of the sharpening device of FIG. 1, viewed from the side.

Within the base enclosure there is a pencil point contour surface 22 defined about a central axis 13, the inside shape of a first embodiment of which is depicted in FIG. 4. This contour matches the desired shape of the sharpened end of the pencil; it presents a narrow portion near the point extremity of the pencil and a wider portion further up the pencil shaft away from the point extremity. As shown most clearly in FIGS. 4 and 5, this contour surface is of the general shape of a longitudinally concave cone oriented to present its narrow portion near the point extremity of the pencil.

In the first embodiment (see FIG. 5), the edge 22*a* of the contoured surface 22 presents a single radius curve in cross section which creates a curved cone shape for the desired shape of the sharpened pencil. In this embodiment a corresponding single radius curve is also employed for the radius of the curve of the blade. In the preferred embodiment of this curved version of the sharpening device, the radius of the curve is approximately 2¼ inches in length.

Figure 8:
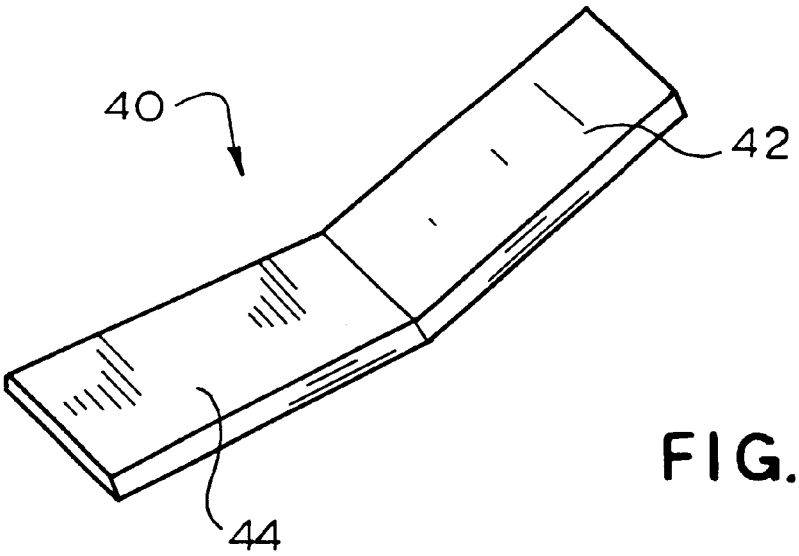
FIG. 8 is a perspective view of the alternate blade design of the sharpening device of FIG. 7.
Figure 7:
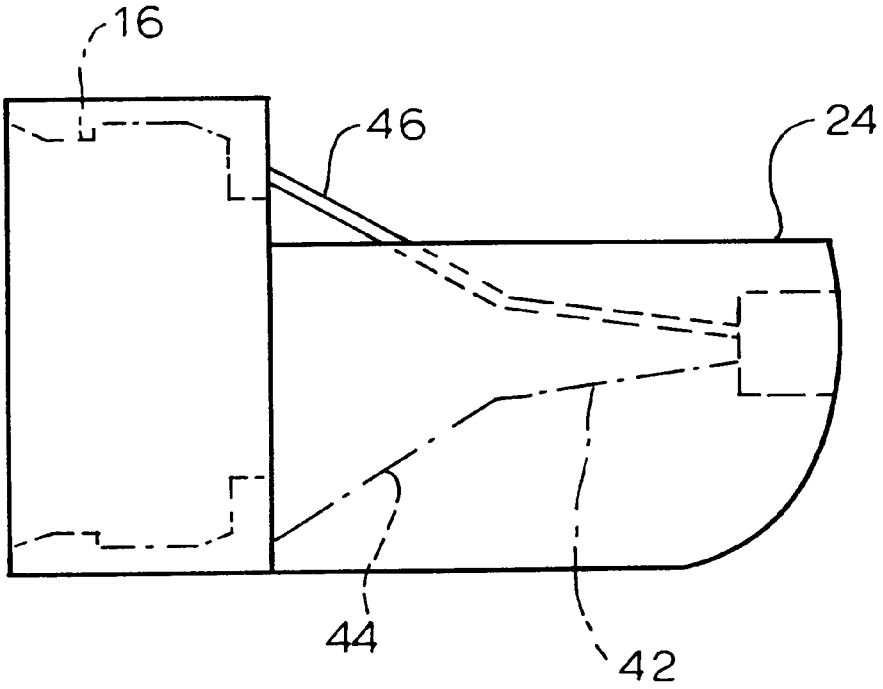
FIG. 7 is a cross section view of the base enclosure portion of an alternate embodiment of the sharpening device employing an alternate version of the blade design.

In a second embodiment (see FIG. 7 and FIG. 8) the blade 40 is formed from a plurality of sections, 42 and 44, and the contoured surface presents, in cross section, an edge 46 having sections corresponding to the blade sections. These sections can be straight or curved and additional sections can be included to create a more complicated cut if desired. Accordingly, it can be appreciated that by employing multiple sections, a contoured surface is created which is similar to the curved cone shape and matches the desired shape of the sharpened pencil point; a narrow contour near the pencil point and a wider contour away from the point.

When the carpenter's pencil is cut to the described contoured shape, a narrow cut is made around the point while a wider cut is made further up on the pencil. Consequently, when the pencil and collar are rotated relative to the enclosure, wood is sufficiently removed from all sides around the pencil point, including the wood from the flat sides 23 (FIG. 1) of the pencil shaft, and a graduated transition is provided from the vicinity of the pencil point to the body of the pencil shaft.

As best shown in FIG. 1, the base enclosure is open 24 on one side, being cut-away to allow for removal of debris cut from the pencil during the sharpening process. At this open side the contoured surface 22 is interrupted with a narrow slot opening 25 where the blade 26 is mounted along the contoured surface to present a blade edge 28 tangentially to the contoured surface at the slot opening.

From the foregoing description, it will be apparent that modifications can be made to the apparatus without departing from the teachings of the present invention. Accordingly, the scope of the invention is only to be limited as necessitated by the accompanying claims.

What is claimed is:

1. A pencil sharpening device for cutting a point on the extremity of a flat pencil comprising:

a base enclosure having a pencil point contour surface defined therein, said contour surface having the general shape of a longitudinally concave cone, being defined about a central axis and being oriented to present its narrow portion near the point extremity of the pencil;

a curved blade mounted within said base enclosure, said blade having a cutting edge positioned along said contour surface for cutting against the pencil when the pencil is rotated about said central axis; and centering means for centering the flat pencil along said central axis for rotation thereabout.

2. The device of claim 1 wherein said centering means comprises a collar having a slot therein for receiving the pencil, and wherein said collar is mounted for selective rotation of the pencil and said collar relative to said base enclosure.

3. The device of claim 2 wherein said base enclosure exhibits an encircling track and said collar exhibits an encircling shoulder arranged to fit within said encircling track of said base enclosure for enabling said rotation of said collar relative to said base enclosure.

4. The device of claim 2 further comprising a plurality of intersecting slots defined in said collar for accommodating a plurality of pencil sizes.

5. The device of claim 1 further comprising an open section defined in said base enclosure for allowing the exit of debris.

6. The device of claim 1 wherein said blade curvature is a single radius curve with a radius of approximately 2¼ inches.

7. The device of claim 5 wherein said centering means comprises a collar having a slot therein for receiving the pencil, and wherein said collar is mounted for selective rotation of the pencil and said collar relative to said base enclosure.

8. The device of claim 7 wherein said base enclosure exhibits an encircling track and said collar exhibits an encircling shoulder arranged to fit within said encircling track of said base enclosure for enabling said rotation of said collar relative to said base enclosure.

9. The device of claim 7 further comprising a plurality of intersecting slots defined in said collar for accommodating a plurality of pencil sizes.

10. The device of claim 9 wherein said collar is selectively removable from said base enclosure.

11. The device of claim 10 wherein said blade is mounted to present said cutting edge tangentially to said contour surface.

12. A pencil sharpening device for cutting a point on the extremity of a pencil comprising:

a base enclosure having a pencil point contour surface defined therein, said contour surface having the general shape of a longitudinally concave cone, being defined about a central axis and being oriented to present its narrow portion near the point extremity of the pencil;

a blade mounted within said base enclosure, said blade exhibiting a plurality of sections and having a cutting edge positioned along said contour surface for cutting against the pencil when the pencil is rotated about said central axis; and centering means for centering the flat pencil along said central axis for rotation thereabout.

13. The device of claim 12 wherein said base enclosure exhibits an encircling track and said collar exhibits an encircling shoulder arranged to fit within said encircling track of said base enclosure for enabling said rotation of said collar relative to said base enclosure.

14. The device of claim 13 further comprising a plurality of intersecting slots defined in said collar for accommodating a plurality of pencil sizes.

15. The device of claim 12 wherein said blade is mounted to present said cutting edge tangentially to said contour surface.

16. The device of claim 12 wherein said blade exhibits two straight sections.

17. The device of claim 12 wherein said centering means comprises a collar having a slot therein for receiving the pencil, and wherein said collar is mounted for selective rotation of the pencil and said collar relative to said base enclosure.

18. The device of claim 17 wherein said base enclosure exhibits an encircling track and said collar exhibits an encircling shoulder arranged to fit within said encircling track of said base enclosure for enabling said rotation of said collar relative to said base enclosure.

19. The device of claim 18 further comprising a plurality of intersecting slots defined in said collar for accommodating a plurality of pencil sizes.

20. The device of claim 19 wherein said blade exhibits two straight sections.

* * * * *